US009947488B2

(12) United States Patent
Mendoza

(10) Patent No.: US 9,947,488 B2
(45) Date of Patent: Apr. 17, 2018

(54) ELECTRICAL SWITCH GANGING SYSTEM AND METHOD

(71) Applicant: ABB Technology AG, Zurich (CH)

(72) Inventor: Malbin J. Mendoza, Weston, FL (US)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/137,752

(22) Filed: Apr. 25, 2016

(65) Prior Publication Data

US 2017/0309416 A1 Oct. 26, 2017

(51) Int. Cl.

| | |
|---|---|
| ***H01H 9/26*** | (2006.01) |
| *H01H 31/04* | (2006.01) |
| *H01H 9/28* | (2006.01) |

(52) U.S. Cl.

CPC ..... *H01H 9/26* (2013.01); *H01H 9/28* (2013.01); *H01H 9/283* (2013.01); *H01H 31/04* (2013.01); *H01H 2009/265* (2013.01)

(58) Field of Classification Search

CPC ..... H01H 50/323; H01H 71/1018; H01H 71/1027; H01H 83/20; H01H 71/1009; H01H 9/283; H01H 9/282; H01H 9/28; H01H 9/26

USPC .... 200/50.32, 331, 50.02, 1 R, 50.33, 43.22, 200/43.01, 43.13, 43.19; 411/417, 418

See application file for complete search history.

(56) References Cited

U.S. PATENT DOCUMENTS

| | | | | |
|---|---|---|---|---|
| 2,277,645 | A | 3/1942 | Johnson | |
| 3,110,779 | A | 11/1963 | Cotton | |
| 5,172,087 | A | 12/1992 | Castonguay et al. | |
| 7,449,983 | B2 * | 11/2008 | Zindler | H01H 71/1018 200/50.32 |
| 7,795,550 | B2 | 9/2010 | McCoy | |
| 9,312,083 | B1 * | 4/2016 | Czarnecki | H01H 9/26 |

OTHER PUBLICATIONS

ABB Inc., FT FlexitestTM Switches, Descriptive Bulletin 41-077M, Apr. 2010, 32 pgs.

* cited by examiner

*Primary Examiner* — Ahmed Saeed

(74) *Attorney, Agent, or Firm* — Taft Stettinius & Hollister LLP

(57) ABSTRACT

A fastener is provided for ganging or joining two or more switch handles to one another. The fastener includes a head at one end and an elongated shank extending from the head. The shank includes a threaded portion adjacent the head that threadingly engages one of the switch handles. The shank extends longitudinally from the threaded portion through the threadingly engaged switch handle and through one or more additional switch handles to gang the switch handles to one another.

20 Claims, 2 Drawing Sheets

ELECTRICAL SWITCH GANGING SYSTEM AND METHOD

FIELD OF THE INVENTION

The present invention relates to electrical switches, and more particularly to a system and method for ganging two or more electrical switches to one another.

BACKGROUND

Electrical switches can be employed in circuit break panels, relays, meters and other associated equipment. For example, electrical switches can be used to selectively isolate electrical equipment for maintenance and testing of the electrical components. Examples of electrical switches are provided in Descriptive Bulletin 41-077 effective April 2010 by ABB, Inc., entitled FT Flexitest™ Switches, which is incorporated herein by reference. Other types of electrical switches are also contemplated.

A plurality of electrical switches can be provided in side-by-side relation. The electrical switches typically each include a handle that allow the respective switch to be easily manipulated. For certain applications, it is desirable to gang multiple electrical switches by connecting their respective handles to one another with a tie-bar so the connected switches can be manipulated simultaneously. However, known tie-bars suffer from various drawbacks, such as being difficult and time consuming to install and causing the ganged switches to be difficult to manipulate due to the tendency of the tie-bar to bind the switch components and hinder movement of the switches. Therefore, further improvements in ganging two or more switches are needed.

SUMMARY

In accordance with the present disclosure, a fastener is provided for ganging or joining two or more switch handles to one another. The fastener includes a head at one end and an elongated shank extending from the head. The shank includes a threaded portion adjacent the head that threadingly engages one of the switch handles. The shank extends longitudinally from the threaded portion through the threadingly engaged switch handle and through one or more additional switch handles to gang the switch handles to one another.

In one embodiment, the shank is smooth and is not fixed or axially secured to any of the switch handles except to the first switch handle at the threaded portion. In further embodiments, the length of the shank can be sized to extend through any number of switch handles, ranging from two to fourteen or more switch handles. In still other embodiments, the threaded portion is self-tapping and forms thread in the switch handle as it is threaded into the switch handle. Other embodiments contemplate other features, as described further below.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
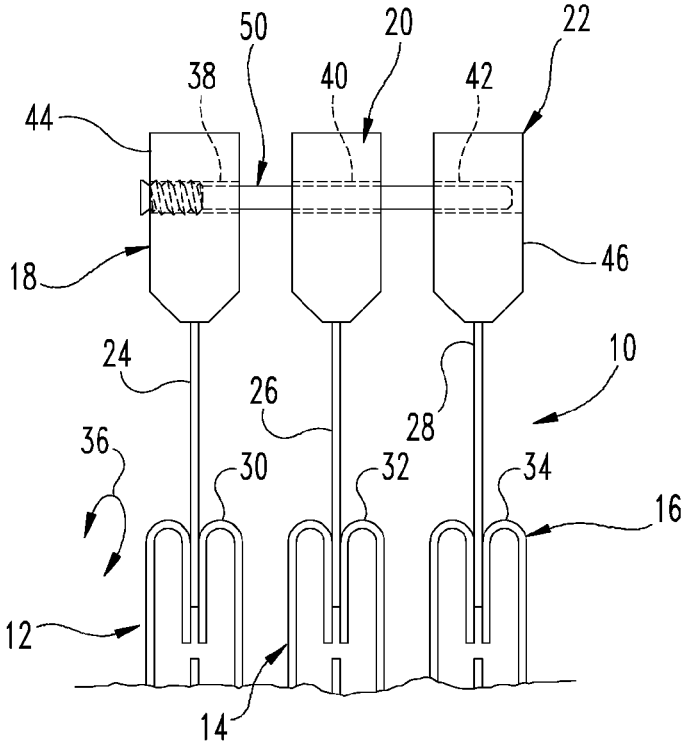
FIG. 1 shows a schematic elevation view of part of a ganged switch system.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring to FIG. 1, there is shown schematically a part of a switch system 10. Switch system 10 includes a plurality of electrical switches 12, 14, and 16, it being understood that the number of the plurality of switches can range from two switches to fourteen or more switches. Electrical switches 12, 14, 16 each include a switch handle 18, 20, 22 extending from respective ones of blades 24, 26, 28. Blades 24, 26, 28 are mounted to respective components 30, 32, 34 of the respective electrical switches 12, 14, 16. Switch handles 18, 20, 22 can be manipulated by a person such as a technician to selectively pivot or rotate, as indicated by arrow 36, the switch blades 24, 26, 28 to selectively open and close switches 12, 14, 16 relative to its respective components 30, 32, 34.

Two or more of switches 12, 14, 16 can be ganged or joined with one another so that manipulation of one of the switch handles 18, 20, 22 is effective to open or close all of the ganged switches 12, 14, 16. A fastener 50 is provided that is positioned through aligned holes 38, 40, 42 formed through each of the switch handles 18, 20, 22. Fastener 50 gangs the switch handles 18, 20, 22 with one another so that the ganged switch handles move in unison.

Figure 2:
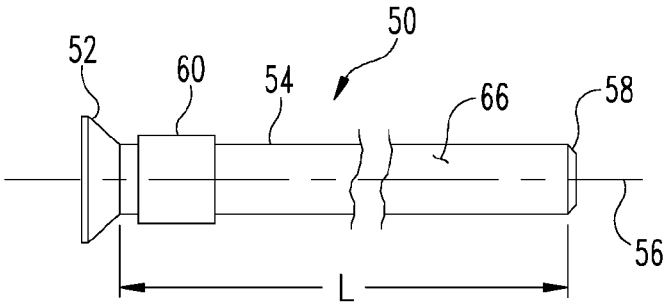
FIG. 2 shows a schematic elevation view of one embodiment fastener for ganging two or more switch handles of the switch system of FIG. 1.
Figure 3:
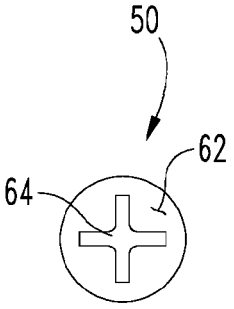
FIG. 3 shows a left side elevation view of the fastener of FIG. 2.

Referring to FIGS. 2-3, fastener 50 includes an enlarged head 52 at a first end thereof and an elongated shank 54 extending from head 52 along a longitudinal axis 56 to a second end 58 of fastener 50. Fastener 50 further includes a threaded portion 60 adjacent to head 50 that extends along a part of the length L of shank 54. As discussed further below, length L can vary depending on the number of switches to be ganged. In addition, fastener 50 can be of a single piece or unitary construction and made from a metal material. The fastener 50 therefore includes just a single component to gang multiple switches, reducing or eliminating the fiddling and assembly time associated with multiple component tie-bars.

Head 50 includes an end face 62 and is configured to engage a driving tool. In the illustrated embodiment, end face 62 includes an internal tool receiving recess 64 formed therein. Tool receiving recess 64 is a Phillips type recess in the illustrated embodiment, but other configurations are also contemplated, including slotted recesses, star shaped recesses, Torx® type recesses, and hex shaped recesses, to name a few. It is also contemplated that head 52 could include a perimeter around end face 62 configured to engage an externally positioned driving tool such as a wrench.

Referring back to FIG. 1, fastener 50 is positioned through aligned hole of switch handles 18, 20, 22 so that threaded portion 60 is within hole 38 of first switch handle 18 and second end 58 is within hole 42 of the last switch handle to be ganged, which is third switch handle 22 in the illustrated embodiment. Threaded portion 60 is threadingly engaged with first switch handle 18 within hole 38 and head 52 abuttingly engages a sidewall 44 of switch handle 18 through which hole 38 opens. In one embodiment, threaded portion 60 includes a self-tapping thread that is configured to cut a thread into the material of switch handle 18 as fastener 50 is threaded into switch handle 18. In one embodiment, switch handle 18 is made from any suitable plastic type material into which threads can be cut or tapped by threaded portions 60. The length of threaded portion 60 along shank 54 is sized so that threaded portion 60 only engages the first switch handle to be ganged.

When head 52 is in abutting engagement with sidewall 44 of switch handle 18, second end 58 can be recessed within hole 42 of the last connected switch handle 22 so as to not protrude outwardly from lateral side wall 46 of switch handle 22. This arrangement prevents shank 54 from interfering with an adjacent switch handle should one be located next to switch handle 22. In other embodiments, end 58 of shank 52 can protrude from lateral wall 46.

Threaded portion 60 provided an axially fixed engagement of fastener 50 with first switch handle 18 within hole 38. The axially fixed engagement prevents fastener 50 from axially displacing relative to switch handle 18. In addition, the threaded engagement provides resistance to rotation of fastener 50 relative to switch handle 18. Shank 54 includes a circular cross-section extending from threaded portion 60 to second end 58 and has a smooth outer surface 66 along this part of shank 54. Therefore, shank 54 is not axially or rotationally fixed to any other of the switch handles 20, 22. As a result, fastener 50 does not provide any force along longitudinal axis 56 that urges the switch handles 18, 20, 22 toward or away from one another. This allows fastener 50 to gang switch handles 20, 22 to first switch handle 18 without binding or hindering movement of the switch handles 18, 20, 22 simultaneously with one another.

Referring to FIGS. 4A-4D, there are shown various embodiments of fastener 50, designated as fasteners 70, 72, 74, 76, respectively. Fasteners 70, 72, 74, 76 include the same features as fastener 50 discussed above, but are shown with varying lengths sized for ganging different numbers of switches to one another. For example, fastener 70 includes a length L1 sized to gang two switch handles. Fastener 72 includes a length L2 sized to gang three switch handles, such as shown in FIG. 1. Fastener 74 includes a length L3 sized to gang four switch handles, and fastener 76 includes a length L4 sized to gang ten switch handles. Other lengths are contemplated for ganging any number of switch handles, up to fourteen or more switch handles.

Figure 5A:
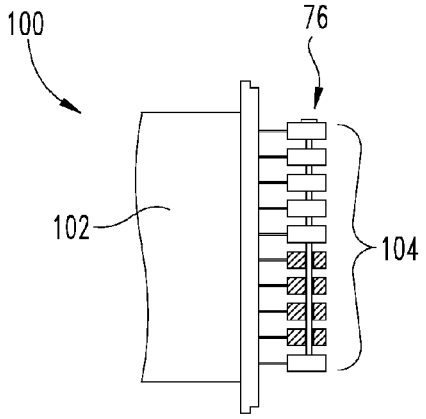
FIG. 5A is a schematic view of one embodiment of a ganged switch system with part of the switch handles shown in section and employing a singled fastener to gang all switch handles.

Referring to FIG. 5A, a switch system 100 is shown that includes a base 102 for housing a plurality of switch components such as components 30, 32, 34. Switch system 100 further includes a plurality of switch handles, collectively designated as switch handles 104, which are connected to the switch components with respective switch blades 24, 26, 28. Fastener 76 extends through and gangs all of the plurality of switch handles 104 to one another so that all ten switch handles 104 are joined by fastener 76 and move simultaneously.

Figure 5B:
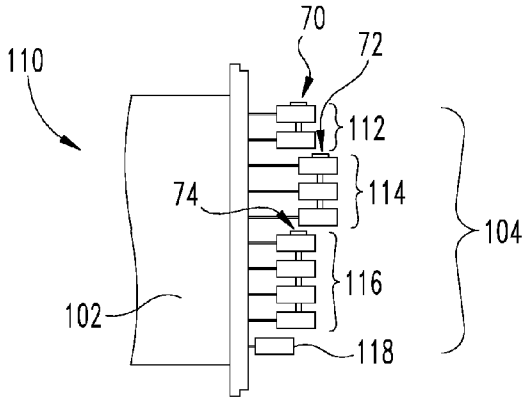
FIG. 5B is a schematic view of another embodiment of a ganged switch system employing multiple fasteners to gang multiple portions of the switch handles.
Figure 4A:
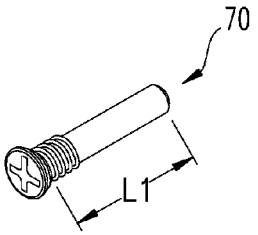
FIGS. 4A-4D show various embodiments of the fastener of FIG. 2.
Figure 4B:
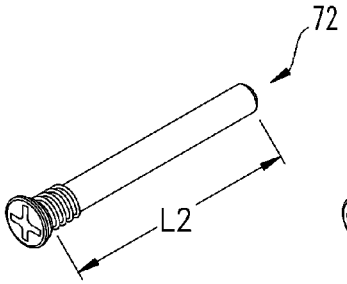
Figure 4C:
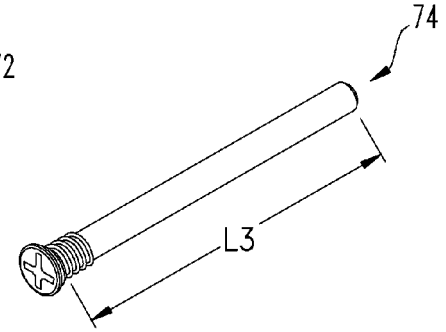
Figure 4D:
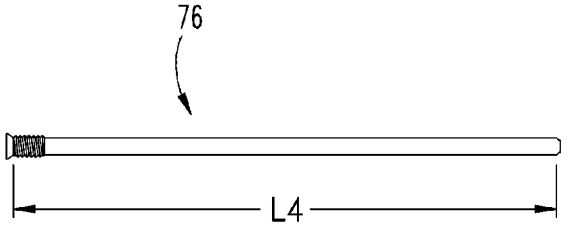

Referring to FIG. 5B, another embodiment switch system 110 is shown with a plurality of switch handles 104 shown. In this embodiment, each of the fasteners 70, 72, 74 is employed to gang a subset of the switch handles to one another. For example, fastener 70 gangs two switch handles 112, fastener 72 gangs three switch handles 114, and fastener 74 gangs four switch handles 116. A single switch handle 118 is provided that is not ganged with another other switch.

Various aspects of the present disclosure are contemplated. In one aspect, a switch system is provided. The switch system includes a base configured to house switch components and a plurality of electrical switches connected to the switch components. The electrical switches include a plurality of blades connected to the switch components and a plurality of switch handles connected to respective ones of the plurality of blades. The plurality of switch handles are positioned in side-by-side relation with one another and a fastener extending through at least two switch handles of the plurality of switch handles. The fastener includes a head at a first end of the fastener and a shank extending longitudinally from the head to a second end of the fastener opposite the first end. The shank includes a threaded portion adjacent the head that is threadingly engaged to a first switch handle of the at least two switch handles, and the elongated shank extends from the threaded portion through the at least two switch handles to the second end of the fastener to gang the at least two switch handles to one another.

According to one embodiment, the second end of the shank of the fastener is located within a last one of the at least two switch handles ganged to the first switch handle. In another embodiment, the head of the fastener is enlarged relative to the shank and includes a driving tool recess, and the shank includes a circular cross-section and a smooth outer surface extending from the threaded portion to the second end.

In another embodiment, the plurality of switch handles includes two switch handles. In yet another embodiment, the plurality of switch handles includes three or more switch handles. In still another embodiment, the fastener includes at least two fasteners, where a first one of the at least two fasteners gangs together the at least two switch handles and a second one of the at least two fasteners gangs together at least two other switch handles of the plurality of switch handles.

In another embodiment, threaded portion is configured to self-tap into a material of the first switch handle as the fastener is driven into the first switch handle. In a refinement of this embodiment, each of the at least two switch handles includes a hole extending therethrough and the holes are aligned to receive the fastener. In another refinement of this embodiment, the switch handle is comprised of plastic and the fastener is comprised of metal.

According to another aspect, a method for ganging electrical switches includes: selecting at least two switches to be ganged with one another from a plurality switches; aligning holes in adjacent switch handles of the selected switches; inserting an elongated shank of a fastener into the aligned holes of the switch handles of the selected two switches; and threadingly engaging the fastener within the hole of the switch handle of a first one of the selected switches so the elongated shank of the fastener extends through the aligned holes of the switch handles of the selected switches.

In one embodiment of the method, the fastener includes a first end having an enlarged head, the shank extends from the enlarged head to an opposite second end of the fastener, and a threaded portion is provided on the shank adjacent the head. In a refinement of this embodiment, the shank defines a circular cross-section and a smooth outer surface from the threaded portion to the second end of the fastener. In another refinement of this embodiment, the second end of the fastener is recessed within the switch handle of a last one of the selected switches that is opposite the first one of the selected switches threadingly engaged by the fastener. In yet another refinement of this embodiment, the shank of the fastener extends along a longitudinal axis and the fastener is axially fixed to the switch handle of the first one of the selected switches and the fastener is not axially fixed to the switch handles of any other of the at least two switches. In still another refinement of this embodiment of the method, threadingly engaging the fastener includes the threaded portion of the fastener forming self-tapping threads into a material of the switch handle of the first one of the selected switches.

In one embodiment, the at least two switches includes three or more switches. In another embodiment, the switch handles are comprised of plastic and the fastener is comprised of metal.

According to another aspect, an apparatus includes at least two electrical switches including a first switch handle and a second switch handle. Each of the at least two switch handles defines a hole therethrough. A fastener extends through the holes of the first and second switch handles. A first end of the fastener is axially fixed to the first switch handle and a second end of the fastener opposite the first end is recessed within the second switch handle.

In one embodiment, the fastener includes a head at the first end of the fastener and a threaded portion adjacent the head that is threadingly engaged within the hole of the first switch handle, and the fastener further includes a smooth shank extending from the threaded portion to the second end of the fastener. In a refinement of this embodiment, the threaded portion is self-tapping to form threads within the switch handle as the fastener is threadingly engaged in the hole of the first switch handle.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope.

What is claimed is:

1. An electrical switch system, comprising:

a base configured to house switch components;

a plurality of electrical switches connected to the switch components;

a plurality of blades connected to the switch components;

a plurality of switch handles connected to respective ones of the plurality of blades, the plurality of switch handles being positioned in side-by-side relation with one another; and a fastener extending through at least two switch handles of the plurality of switch handles, wherein the fastener includes a head at a first end of the fastener and a shank extending longitudinally from the head to a second end of the fastener opposite the first end, wherein the shank includes a threaded portion adjacent the head that is located within and threadingly engaged to a first switch handle of the at least two switch handles, and the elongated shank includes a non-threaded portion that extends from the threaded portion through the at least two switch handles to the second end of the fastener to gang the at least two switch handles to one another.

2. The switch system of claim 1, wherein the second end of the fastener is located within a last one of the at least two switch handles ganged to the first switch handle.

3. The switch system of claim 1, wherein:

the head of the fastener is enlarged relative to the shank and includes a driving tool recess; and the shank includes a circular cross-section and a smooth outer surface extending from the threaded portion to the second end.

4. The switch system of claim 1, wherein the plurality of switch handles includes two switch handles.

5. The switch system of claim 1, wherein the plurality of switch handles includes three or more switch handles.

6. The switch system of claim 1, wherein the fastener includes at least two fasteners, wherein a first one of the at least two fasteners gangs together the at least two switch handles and a second one of the at least two fasteners gangs together at least two other switch handles of the plurality of switch handles.

7. The switch system of claim 1, wherein the threaded portion is configured to self-tap into a material of the first switch handle as the fastener is driven into the first switch handle.

8. The switch system of claim 7, wherein each of the at least two switch handles includes a hole extending therethrough and the holes are aligned to receive the fastener.

9. The switch system of claim 7, wherein the switch handle is comprised of plastic and the fastener is comprised of metal.

10. A method for ganging electrical switches, comprising:

selecting at least two switches to be ganged with one another from a plurality switches;

aligning holes in adjacent switch handles of the selected switches;

inserting an elongated shank of a fastener into the aligned holes of the switch handles of the selected switches; and threadingly engaging the fastener within one of the aligned holes of the adjacent switch handles of a first one of the selected switches, wherein the elongated shank of the fastener includes a non-threaded portion that extends from the threaded engagement of the fastener within the one of the aligned holes and through another of the aligned holes of the adjacent switch handles of the selected switches.

11. The method of claim 10, wherein the fastener includes:

a first end having an enlarged head;

the shank extends from the enlarged head to an opposite second end of the fastener; and a threaded portion is provided on the shank adjacent the head.

12. The method of claim 11, wherein the shank defines a circular cross-section and a smooth outer surface from the threaded portion to the second end of the fastener.

13. The method of claim 11, wherein the second end of the fastener is recessed within the switch handle of a last one of the selected switches that is opposite the first one of the selected switches threadingly engaged by the fastener.

14. The method of claim 11, wherein the shank of the fastener extends along a longitudinal axis and the fastener is axially fixed to the switch handle of the first one of the selected switches and the fastener is not axially fixed to the switch handles of any other of the at least two switches.

15. The method of claim 11, wherein threadingly engaging the fastener includes the threaded portion of the fastener forming self-tapping threads into a material of the switch handle of the first one of the selected switches.

16. The method of claim 10, wherein the at least two switches includes three or more switches.

17. The method of claim 10, wherein the switch handles are comprised of plastic and the fastener is comprised of metal.

18. An apparatus comprising:

at least two electrical switches including a first switch handle and a second switch handle;

each of the first and second switch handles defining a hole therethrough; and a fastener extending through the holes of the first and second switch handles, wherein a first end of the fastener is axially fixed by threaded engagement within the hole of the first switch handle and the fastener includes a non-threaded portion that extends from the threaded engagement of the fastener within the hole of the first switch handle to a second end of the fastener opposite the first end that is recessed within and not axially fixed to the second switch handle.

19. The apparatus of claim 18, wherein the fastener includes a head at the first end of the fastener and a threaded portion adjacent the head that is threadingly engaged within the hole of the first switch handle, and the fastener further includes a smooth shank extending from the threaded portion to the second end of the fastener.

20. The apparatus of claim 19, wherein the threaded portion is self-tapping to form threads within the switch handle as the fastener is threadingly engaged in the hole of the first switch handle.

* * * * *